US008172579B2

(12) United States Patent
Pan

(10) Patent No.: US 8,172,579 B2
(45) Date of Patent: May 8, 2012

(54) ELECTRICAL CONNECTOR HAVING DUST-PROOF SHUTTER DRIVEN BY MAGNETIC FORCE

(75) Inventor: Biao Pan, Kunshan (CN)

(73) Assignee: Hon Hai Precision Ind. Co. Ltd., New Taipei (TW)

( * ) Notice: Subject to any disclaimer, the term of this patent is extended or adjusted under 35 U.S.C. 154(b) by 0 days.

(21) Appl. No.: 12/969,476

(22) Filed: Dec. 15, 2010

(65) Prior Publication Data

US 2011/0143555 A1 Jun. 16, 2011

(30) Foreign Application Priority Data

Dec. 15, 2009 (CN) ..... 2009 2 0317439

(51) Int. Cl.
*H01R 11/30* (2006.01)

(52) U.S. Cl. ..... 439/38

(58) Field of Classification Search ..... 439/38, 439/140–141

See application file for complete search history.

(56) References Cited

U.S. PATENT DOCUMENTS 3,995,209 A * 11/1976 Weston ..... 323/355
5,520,546 A * 5/1996 Klinger et al. ..... 439/140
2007/0167076 A1 7/2007 Seh et al.

* cited by examiner

*Primary Examiner* — Phuong Dinh

(74) *Attorney, Agent, or Firm* — Andrew C. Cheng; Wei Te Chung; Ming Chieh Chang

(57) ABSTRACT

An electrical connector includes an insulative housing (1) defining a mating compartment (10) with an opening (101) in communication with the mating compartment (10), a plurality of contact terminals (2) disposed within the mating compartment (10), a moveable protective lid (4) moveably disposed adjacent to the opening (101) and magnetic arrangement (5, 6) disposed between the protective lid (4) and the housing (1) such that the protective lid (4) will resume to its original position by means of magnets (5, 6) arranged between the protective lid (4) and the housing (1).

9 Claims, 6 Drawing Sheets

ELECTRICAL CONNECTOR HAVING DUST-PROOF SHUTTER DRIVEN BY MAGNETIC FORCE

BACKGROUND OF THE INVENTION

1. Field of the Invention

The present invention generally relates to the art of the electrical connectors and, particularly, to an electrical connector having a magnetically-driven movable shutter for protecting an opening in communication to a mating compartment.

2. Description of the Related Art

A typical electrical connector is configured with some form of insulative or dielectric housing housed/harbored with a plurality of conductive terminals for contacting the terminals of a complementary connecting device or mating connector. For instance, a male or plug connector may be provided for mating with a female or receptacle connector to establish electrical transmission through the mated connected assembly. The receptacle connector has an opening for receiving the plug connector. In some instance, a movable shutter is used to close the opening of the receptacle connector to protect the interior terminals thereof, such as disclosed and suggested by US Patent Application Publication No. 2007/0167076 (the '076 Publication) submitted by Seung-Jong Seh et al. on Jul. 19, 2007. When the shutter is moved to an open position during mating from its normally closed position, the interior terminals are accessible through the opening. So the receptacle and the plug connector will be electrically connecting with each other.

Typically, the shutter will automatically move back to its closed position upon unmating of the connectors, as by a spring, such as disclosed in the '076 Publication. The electrical connector includes a shell having an internal cavity and a front opening for receiving a mating portion of the complementary connecting device inserted into the cavity. A housing is mounted in at least a rear portion of the shell and has a mating portion extending forwardly into the cavity. A shutter is slidably mounted in the shell and is formed with a passage for receiving the forwardly extending mating portion of the complementary connecting device which is inserted into the cavity through the front opening in the shell, the shutter is slidably pushed rearwardly from a forward position to a rear position whereat the mating portion of the housing passes through the passage in the shutter for engaging the mating portion of the complementary connecting device.

A spring is disposed in the housing and pushes the shutter sliding to the front opening. However, the spring may be easily deformed so that the shutter will not automatically resume to its closed position upon the unmating of the connectors.

Therefore, an improved electrical connector is desired to overcome the disadvantages of the related arts.

SUMMARY OF THE INVENTION

An object of the present invention is to provide a miniaturization electrical connector with a simple structure.

In order to achieve the above-mentioned object, an electrical connector in accordance with a preferred embodiment of the present invention includes an insulative housing defining a mating compartment with an opening in communication with the mating compartment, a plurality of contact terminals disposed within the mating compartment, a moveable protective lid moveably disposed adjacent to the opening and magnetic arrangement disposed between the protective lid and the housing such that the protective lid will resume to its original position by means of magnets arranged between the protective lid and the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
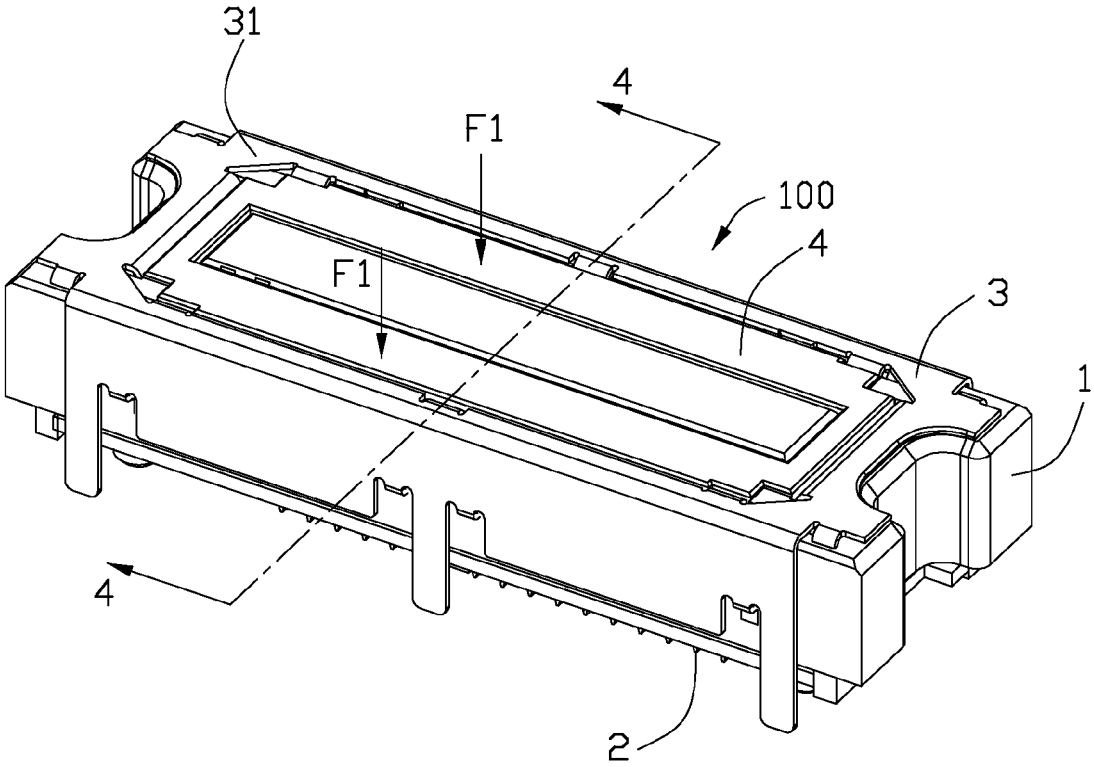
FIG. 1 is a perspective view of an electrical connector in accordance with the preferred embodiment of the present invention.

Reference will now be made to the drawing figures to describe the preferred embodiment of the present invention in detail.

Figure 2:
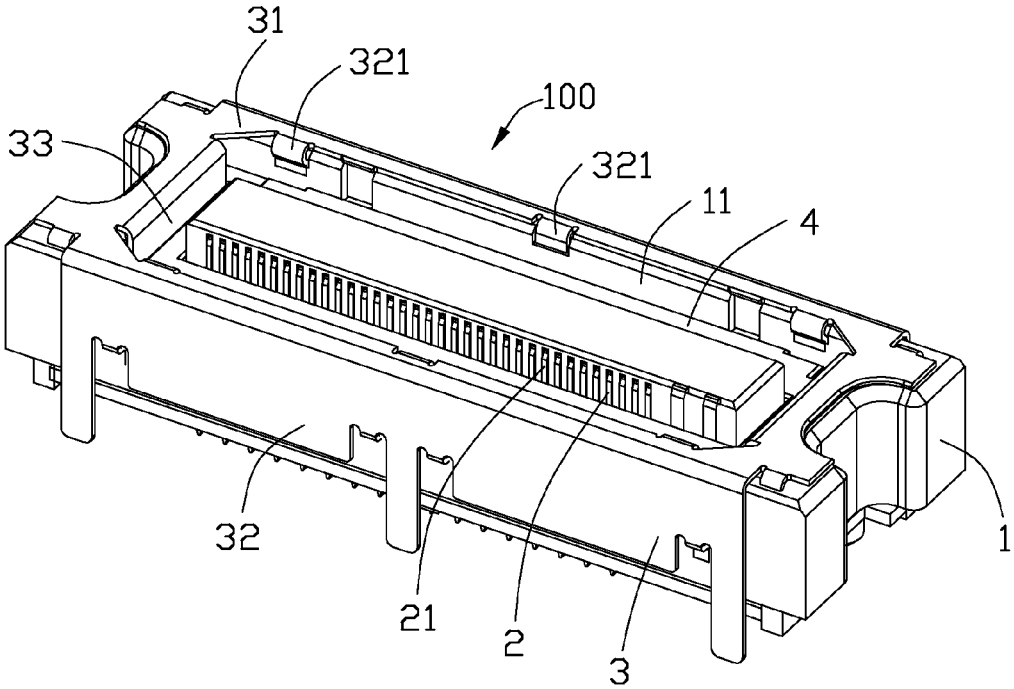
FIG. 2 is another perspective view of the electrical connector in which a movable shutter is moved into an opening position.

Referring to FIGS. 1 and 2, the electrical connector 100 includes an insulative housing 1, a plurality of contact terminals 2 received and retained in the insulative housing 1, a metallic shell 3 covering outside of the insulative housing 1 and a movable shutter 4 (i.e. a moveable protective lid) mounting on the insulative housing 1.

Figure 3:
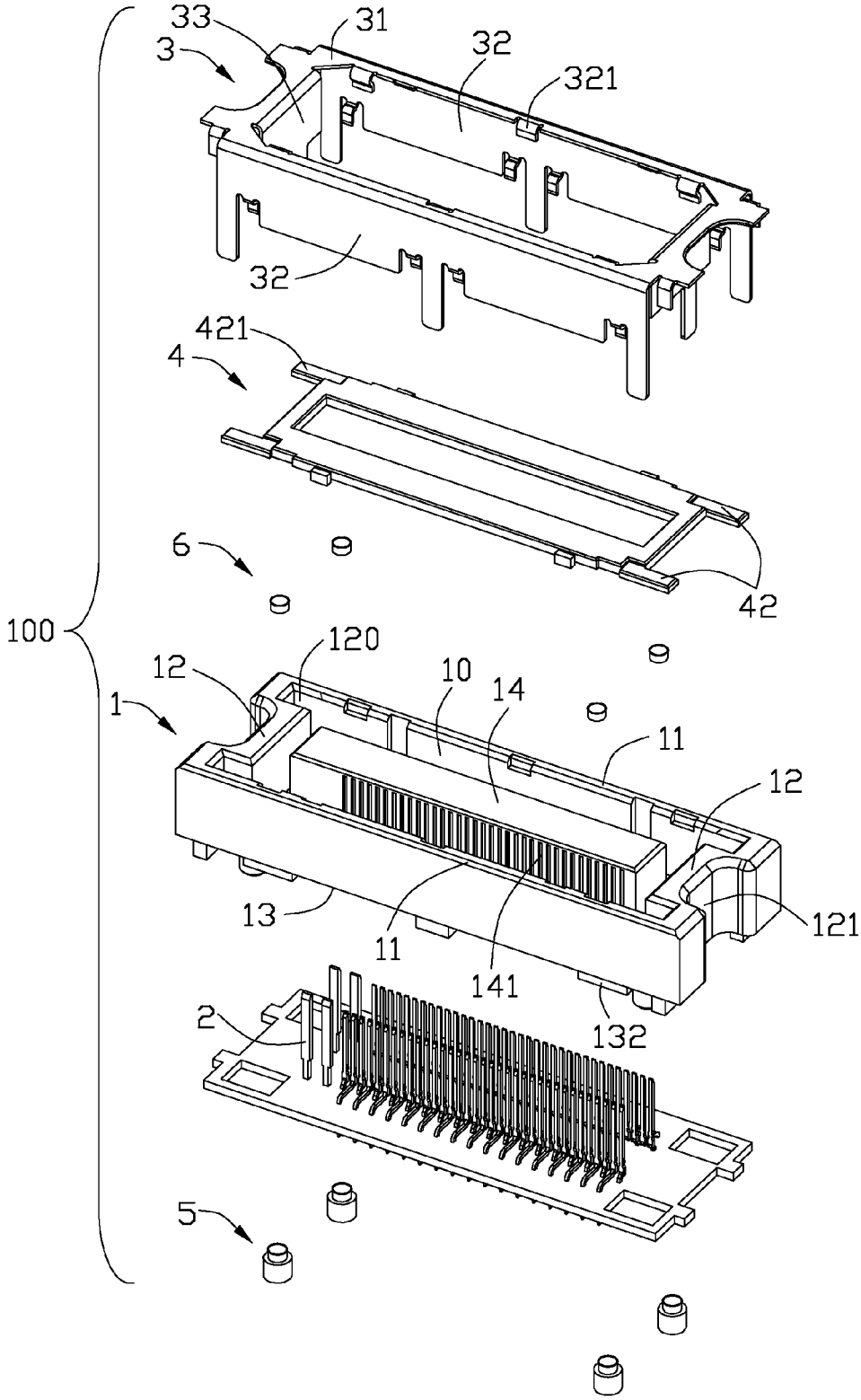
FIG. 3 is an exploded perspective view of FIG. 1.

Referring to the FIGS. 1 and 3, the insulative housing 1 has a pair of longitudinal side walls 11, a pair of end walls 12, a bottom wall 13 perpendicularly connecting to the side walls 11 and the two end walls 12 thereby forming a ringlike mating compartment 10 for mating with a complementary connector (not shown), and a tongue portion 14 extending from the bottom wall 13 towards a forward mating opening 101 of the mating compartment 10. The movable shutter 4 is positioned and slides in the mating compartment 10 along a mating direction between a closed position in which the mating opening 101 is protected by thereof for preventing the dusts from falling into the mating compartment 10 and an opening position in which the mating compartment 10 is opened for permitting the complementary connector inserted therein. The metallic shell 3 includes a plurality of protecting ears 31 abutting against the movable shutter 4 for preventing the movable shutter 4 from moving upwards overly when the movable shutter 4 is located at the close position.

Referring to the FIGS. 1 to 4, the metallic shell 3 also defines a pair of side walls 32, a plurality of abutting ears 321 engaging with the sidewalls 11 and a pair of end walls 33 extending into the mating compartment 10 and engaging with the end wall 12*s* for positioning the metallic shell 3 on the sidewalls 11 steadily. Each of the contact terminals 2 defines a contacting portion 21 disposed on both sides of the tongue portion 14 and extending into the mating compartment 10 and a soldering portion 22 extending outwardly for soldering with a printed circuit board (not shown). When the movable shutter 4 is pressed into the mating compartment 10 downwards by a pressing force (as marked by F1) and slides to the opening position, the tongue portion 14 and the contacting portions 21 are exposed for electrically connecting with the complementary connector (as best seen from FIG. 4).

Figure 4:
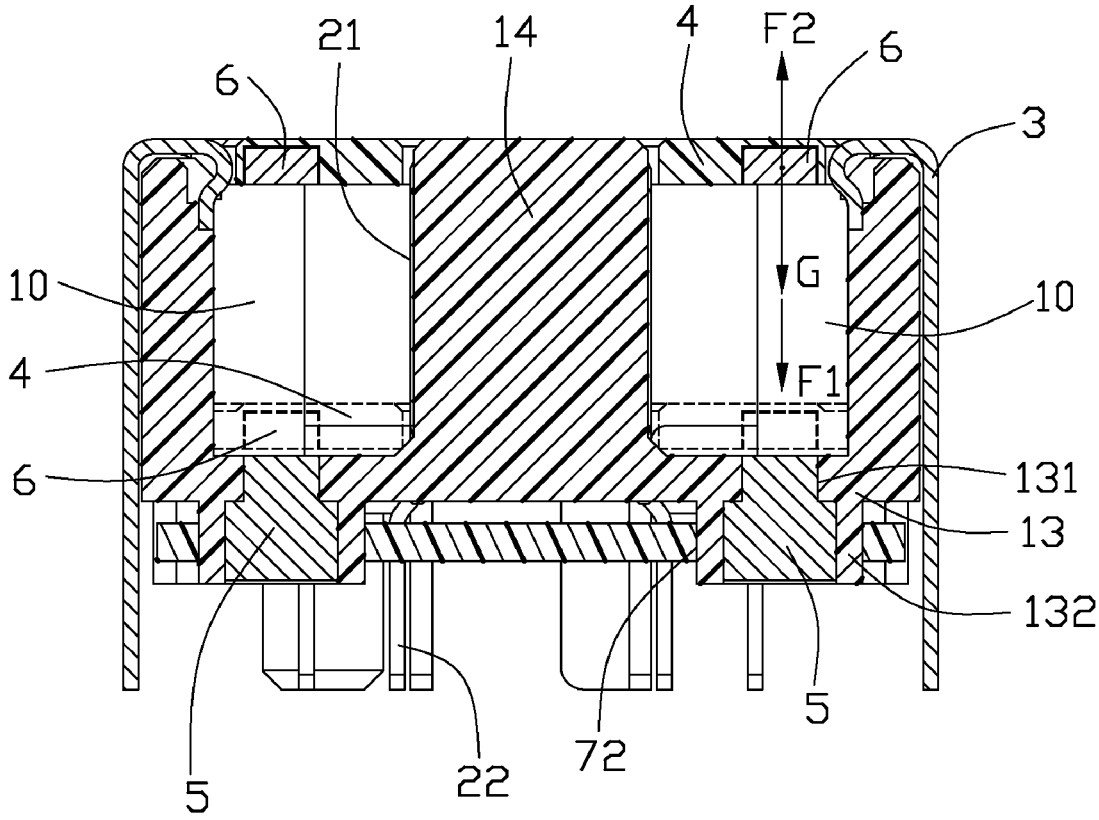
FIG. 4 is a cross-section view of the electrical connector taken along line 4-4 of FIG. 1.
Figure 5:
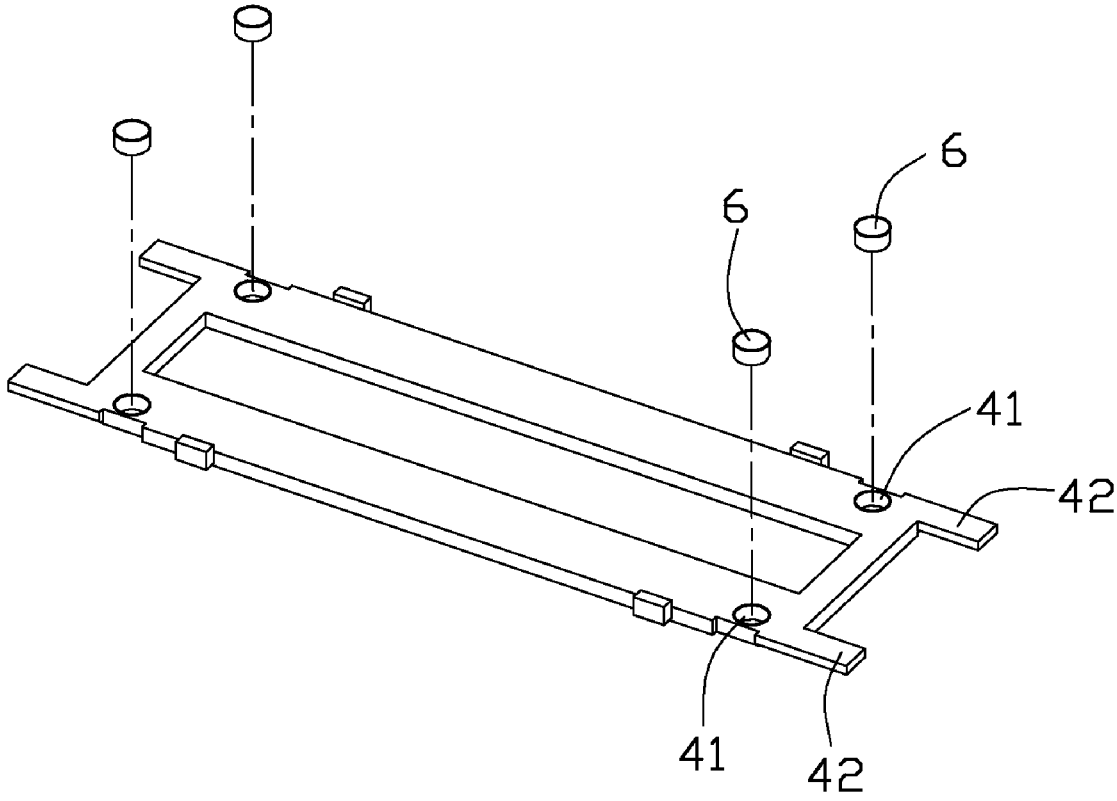
FIG. 5 is a perspective view of the movable shutter and second magnets.

Referring to the FIGS. 3 to 5, the electrical connector 100 furthermore includes a plurality of first magnets 5 disposed and retained in the bottom wall 13, and a second magnets 6 retained in the movable shutter 4. The first magnets 5 and the second magnets 6 are defined as a magnetic arrangement. The first magnet 5 and the magnet 6 are arranged such that they are facing each other with the same polarity, i.e. they will repulse to each other once they approach to each other. Because the first and second magnets 5, 6 have same magnetic (polarity, i.e. south pole to south pole, or north pole to north pole) with each other, the movable shutter 4 would be pushed upwards to the mating opening 101 by a repulsive force (as marked by F2) between the first and second magnets 5, 6. The second magnets 6 are located on an inner surface of the movable shutter and exposed in the mating compartment 10, i.e. the second magnets 6 directly faces to the first magnets 5 located in the mating compartment 10 on the bottom side wall 13. Furthermore, the bottom wall 13 defines a plurality of first mounting holes 131 for retained the first magnets 5 therein.

Figure 6:
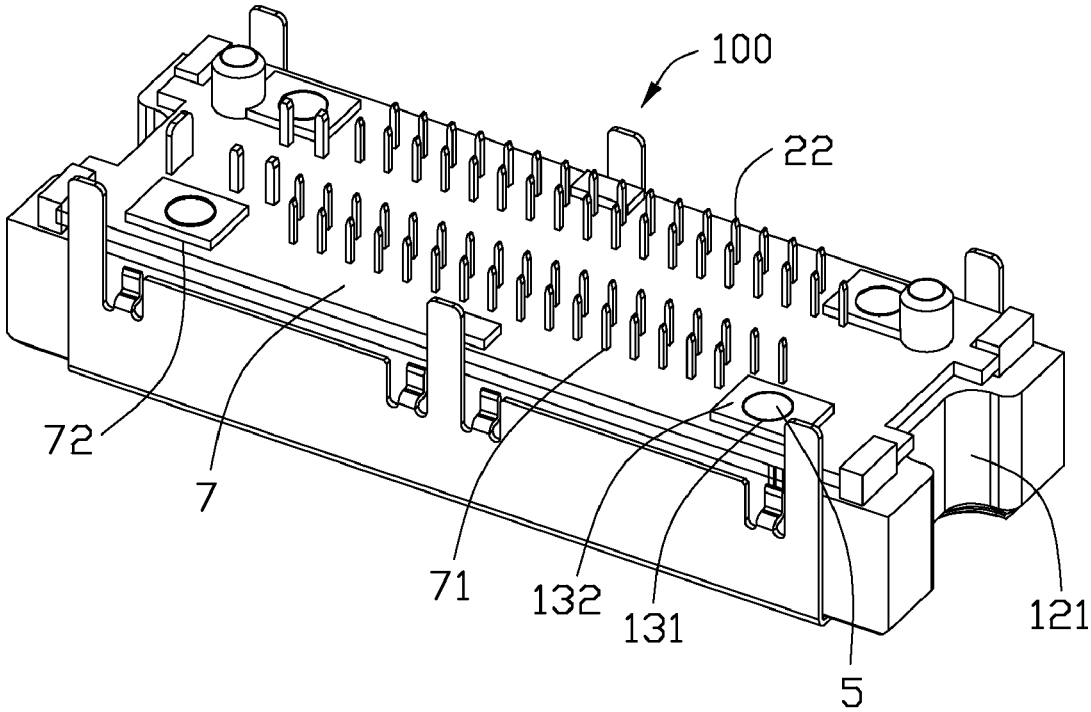
FIG. 6 is another perspective view of the electrical connector viewed from bottom side thereof.

The movable shutter 4 also defines a plurality of second mounting holes 41 for retained the second magnets 6 therein. The first mounting holes 131 are extended into a plurality of protruding tubes 132 that are integrally extended outwards from outside of the bottom wall 13 for decreasing the size of the mating compartment 10 occupied by the first magnets 5. A positioning spacer 7 is provided with a plurality of first grooves 71 for receiving the soldering portion 22 of the contact terminals and a second grooves 72 for receiving the protruding tubes 132 (as best seen from FIGS. 4 and 6).

The number and size of the first and second magnets 5, 6 are same respectively, thereby the repulsive force F2 forced on every area of the movable shutter 4 is balanced. The end wall 12 has a plurality of slots 120 in communicating with the mating compartment 10 and a pair of guiding holes 121 disposed on both ends thereof for guiding the complementary connector inserted into thereof. The movable shutter 4 defines a plurality of sliding portions 42 protruding outwards from out edge of the movable shutter 4 and slides in the slot 120 respectively.

When the complementary connector is drew from the electrical connector 100, the movable shutter 4 is still pushed upwards by the repulsive force F2, i.e. the repulsive force F2 is bigger than the resultant of the pressing force F1 and the gravity force G of the movable shutter 4 and the second magnets 6 ($F2 \geqq G+F1$). When movable shutter 4 is disposed at the close position, i.e. the movable shutter 4 is resume to its original position, the pressing force F1 is equal to zero. When the movable shutter 4 is pressed by the pressing force F1, the resultant of the pressing force F 1 and the gravity force G of the movable shutter 4 and the second magnets 6 is must bigger than the repulsive force F2 ($G+F1 \geqq F2$). Because of the first and second magnets 5, 6 with same magnetic replaces a spring in prior art, the size of the electrical connector 100 will be decrease and the structure thereof is simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining a mating compartment with an opening in communication with the mating compartment;

a plurality of contact terminals disposed within the mating compartment;

a moveable protective lid moveably disposed adjacent to the opening; and wherein magnetic arrangement disposed between the protective lid and the housing such that the protective lid will resume to its original position by means of magnets arranged between the protective lid and the housing; wherein the magnetic arrangement comprises a plurality of first magnets and a plurality of second magnets which are located with an inner surface of the moveable protective lid and exposed to the mating compartment;

further comprises a metallic shell covering outside of the insulative housing which defines a plurality of ears abutting against the moveable protective lid; wherein the insulative housing comprises a bottom wall defining a first mounting hole for retained the first magnet therein; wherein the first mounting holes are extended into a plurality of protruding tubes that are integrally extended outwards from outside of the bottom wall.

2. The electrical connector as described in claim 1, wherein the moveable protective lid comprises a second mounting hole for retained the second magnets therein.

3. The electrical connector as described in claim 1, wherein the moveable protective lid comprises a plurality of sliding portions protruding outwards from out edge thereof and respectively received in a plurality of slots which is formed by the insulative housing and in communicated with the mating compartment.

4. The electrical connector as described in claim 1, wherein the number of the first magnets and the second magnets is same.

5. The electrical connector as described in claim 4, wherein the size of the first magnets and the second magnets is same.

6. The electrical connector as described in claim 1, wherein the insulative housing comprises a pair of guiding holes disposed on both ends thereof.

7. The electrical connector as described in claim 6, wherein the insulative housing comprises four sidewalls and a tongue portion surrounded by the four sidewalls thereby forming the ring like mating compartment.

8. An electrical connector, comprising:

an insulative housing comprising a mating compartment with an upward mating opening;

a plurality of contact terminals retained in the insulative housing;

a movable shutter sliding in mating compartment along a mating direction between a closed position in which the mating opening is protected by thereof and an opening position in which the mating compartment is opened;

wherein a plurality of first magnets are located in the insulative housing and faces to a plurality of second magnets are retained in the movable shutter which is pushed by a repulsive force between the first and second magnets and slides to the closed position from the opening position; wherein the plurality of second magnets are located with an inner surface of the moveable protective shutter and exposed to the mating compartment;

further comprises a metallic shell covering outside of the insulative housing which defines a plurality of ears abutting against the moveable protective shutter; wherein the insulative housing comprises a bottom wall defining a first mounting hole for retained the first magnet therein; wherein the first mounting holes are extended into a plurality of protruding tubes that are integrally extended outwards from outside of the bottom wall.

9. The electrical connector as described in claim 8, wherein the movable shutter a second mounting hole for retained the first magnets therein.

* * * * *